US005422658A

United States Patent [19]

Kawaguchi et al.

[11] Patent Number: 5,422,658

[45] Date of Patent: Jun. 6, 1995

[54] DRIVING METHOD AND A DRIVING DEVICE FOR A DISPLAY DEVICE

[75] Inventors: Takafumi Kawaguchi, Nara; Shiro Takeda, Tenri, both of Japan

[73] Assignee: Sharp Kabushiki Kaisha, Osaka, Japan

[21] Appl. No.: 204,814

[22] Filed: Mar. 2, 1994

Related U.S. Application Data

[63] Continuation of Ser. No. 16,661, Feb. 10, 1993, abandoned, which is a continuation of Ser. No. 659,211, Feb. 22, 1991, abandoned.

[51] Int. Cl.[6] ..... G09G 3/00

[52] U.S. Cl. ..... 345/213; 348/448; 345/204

[58] Field of Search ..... 345/213, 204, 55, 87, 345/88, 99, 204, 214; 348/448, 446, 449, 791, 792, 793

[56] References Cited

U.S. PATENT DOCUMENTS

| | | | |
|---|---|---|---|
| 3,950,607 | 4/1976 | Southworth et al. | 358/134 |
| 4,415,931 | 11/1983 | Dischert | 358/11 |
| 4,605,962 | 8/1986 | Christopher et al. | 358/140 |
| 4,623,913 | 11/1986 | Fling et al. | 358/140 |
| 4,694,439 | 9/1987 | Takeda et al. | 358/241 |
| 4,842,371 | 6/1989 | Yasuda et al. | 340/784 |
| 5,067,021 | 11/1991 | Brody | 358/241 |

FOREIGN PATENT DOCUMENTS

| | | |
|---|---|---|
| 0291252 | 11/1988 | European Pat. Off. . |
| 0373897 | 6/1990 | European Pat. Off. . |
| 53-68514 | 6/1978 | Japan . |
| 55-8157 | 1/1980 | Japan . |
| 60-257683 | 12/1985 | Japan . |

OTHER PUBLICATIONS

Patent Abstracts of Japan, Publication No. JP2083584, Publication Date Mar. 23, 1990.

*Primary Examiner*—Jeffery Brier
*Assistant Examiner*—A. Au
*Attorney, Agent, or Firm*—David G. Conlin; George W. Neuner; Kevin J. Fournier

[57] ABSTRACT

A liquid crystal display panel is so constructed that a plurality of pixels are arranged in a matrix form having the number of lines twice that of horizontal scanning lines for one field of interlaced scanning video signals obtained by scanning an original image every other line, the arrangement of the pixels being shifted horizontally by one-half of a pixel between adjacent upper and lower lines. A row driving circuit applies, to the pixels in the upper line of the two adjacent upper and lower lines, data voltages obtained by sampling a video signal representing one horizontal scanning line by a clock signal of the timing that matches the number of pixels in the upper line and the arrangement of the pixels, and applies, to the pixels in the lower line, data voltages obtained by sampling the above video signal representing one horizontal scanning line by a clock signal of the timing shifted by ½ cycle from the above clock signal. Thus, one horizontal scanning line represented by the video signal is displayed using the two upper and lower lines of pixels, thereby enhancing the display quality of the produced image.

4 Claims, 6 Drawing Sheets

(1)

(2)

(3)

DRIVING METHOD AND A DRIVING DEVICE FOR A DISPLAY DEVICE

This is a continuation of copending application Ser. No. 08/016,661 filed on Feb. 10, 1993, now abandoned which is a continuation of U.S. Ser. No. 07/659,211 filed Feb. 22, 1991, now abandoned.

BACKGROUND OF THE INVENTION

1. Field of the Invention

The present invention relates to a driving method and a driving device for a display device such as a liquid crystal display device which displays an image by sequentially driving pixels arranged in a matrix form.

2. Description of the Prior Art

A method as described below has heretofore been employed, for example, to display an image on an active matrix driving liquid crystal display or the like by using interlaced scanning television video signals obtained by scanning the original image every other line.

When the interlaced scanning television video signals use, for example, 240 horizontal scanning lines per field, pixels are arranged in 240 lines, the number of lines corresponding to that of horizontal scanning lines, on the liquid crystal display panel of the liquid crystal display device, in which a video signal representing one horizontal scanning line is sampled by a clock signal of the timing that matches the number of pixels per line and the arrangement of the pixels so that data voltages obtained by sampling are applied to the corresponding pixels in a particular line. This operation is sequentially performed on all lines of pixels to complete the display of an image for one field.

In this case, the video signal representing, for example, the first horizontal scanning line of an odd-numbered field and the video signal representing the first horizontal line of an even-numbered field both use the pixels in the same first line to display on the liquid crystal display panel, not interlaced with each other for display.

FIG. 1 is a diagram illustrating the interlaced scanning video signals conceptually arranged in the form of an original image to explain the above driving method in a specific manner. In FIG. 1, the original image is horizontally scanned eight times, the first, third, fifth, and seventh horizontal scans producing video signals for the odd-numbered field and the second, fourth, sixth, and eighth scans producing video signals for the even-numbered field.

FIG. 2 is a conceptual diagram illustrating an image reproduced from the interlaced scanning video signals and displayed on an interlaced scanning display device. The image on the display device comprises ten pixels per line, the number of lines being set to eight to match the number of scans of the original image. Also, the pixels are arranged in such a manner as to be shifted horizontally by one-half of a pixel between the odd-numbered and even-numbered lines.

In using the interlaced scanning video signals with the display device shown in FIG. 2, the sampling of a video signal representing one horizontal scanning line in an odd-numbered field is performed at the timing of sampling A indicated by "●" in FIG. 1 in accordance with the arrangement of the pixels in the odd-numbered lines, while the sampling of a video signal representing one horizontal scanning line in an even-numbered field is performed at the timing of sampling B indicated by "o" in FIG. 1 in accordance with the arrangement of the pixels in the even-numbered lines. That is, in the displayed image of FIG. 2, the pixels in the first line, for example, are used, in the odd-numbered field, to display the first horizontal scanning line of the original image represented by the video signal sampled at the timing of sampling A, while the pixels in the second line are used, in the even-numbered field, to display the second horizontal scanning line of the original image represented by the video signal sampled at the timing of sampling B.

FIG. 3 is a conceptual diagram illustrating an image reproduced from the interlaced scanning video signals and displayed on a liquid crystal display panel. FIG. 3(1) shows the displayed image of an odd-numbered field, FIG. 3(2) shows the displayed image of an even-numbered field, and FIG. 3(3) shows an image produced by superposing the odd-numbered field image on the even-numbered field image.

The displayed image shown in FIG. 3 comprises ten pixels per line, the number of lines being set to four to match the number of horizontal scanning lines for one field of the interlaced scanning video signals. That is, the liquid crystal display panel shown comprises four lines of ten pixels.

In using the interlaced scanning video signals with the liquid crystal display panel shown in FIG. 3, the display of an odd-numbered field is performed as shown in FIG. 3(1): the pixels in the first line are used to display the first horizontal scanning line of the original image represented by the video signal sampled at the timing of sampling A, the pixels in the second line used to display the third horizontal scanning line of the original image represented by the video signal sampled at the timing of sampling B, the pixels in the third line used to display the fifth horizontal scanning line of the original image represented by the video signal sampled at the timing of sampling A, and the pixels in the fourth line used to display the seventh horizontal scanning line of the original image represented by the video signal sampled at the timing of sampling B. On the other hand, the display of an even-numbered field is performed as shown in FIG. 3(2): the pixels in the first line are used to display the second horizontal scanning line of the original image represented by the video signal sampled at the timing of sampling A, the pixels in the second line used to display the fourth horizontal scanning line of the original image represented by the video signal sampled at the timing of sampling B, the pixels in the third line used to display the sixth horizontal line of the original image represented by the video signal sampled at the timing of sampling A, and the pixels in the fourth line used to display the eighth horizontal line of the original image represented by the video signal sampled at the timing of sampling B. Thus, two types of sampling timing different from line to line are selected alternately according to the shifted arrangement of the pixels between the odd-numbered and even-numbered lines on the liquid crystal display panel.

Thus, the image of the odd-numbered field shown in FIG. 3(1) and the image of the even-numbered field shown in FIG. 3(2) are displayed alternately on the liquid crystal display panel, producing a visual result as shown in FIG. 3(3) in which the image of the odd-numbered field is superposed on the image of the even-numbered field.

As described above, in the prior art driving method for displaying an image on a non-interlaced scanning display device using interlaced scanning video signals, the pixels in the same line are used to alternately display the image reproduced from the video signal of an odd-number field and the image reproduced from the video signal of an even-numbered field. As a result, the prior art has the problem that the display quality drops substantially compared with the display screen provided by an interlaced scanning display device. This tendency becomes even more appreciable as the size of the display screen becomes larger. In particular, in the case of displaying an image having diagonal lines as shown in FIGS. 1 to 3, a marked drop in the reproducibility of the diagonal lines is noted as is apparent from the comparison between FIG. 2 and FIG. 3(3).

SUMMARY OF THE INVENTION

It is an object of the invention to provide a driving method and a driving device for a display device by which interlaced scanning video signals can be used with a non-interlaced scanning display device without causing degradation in the display quality.

The invention provides a driving method for a display device, wherein:

a plurality of pixels are arranged in a matrix form having the number of lines twice that of horizontal scanning lines for one field of interlaced scanning video signals obtained by scanning an original image every other line, the arrangement of the pixels being shifted horizontally by one-half of a pixel between adjacent upper and lower lines;

a video signal representing one horizontal scanning line is sampled by a clock signal of the timing that matches the number of pixels in the upper line and the arrangement of the pixels in the upper line, to obtain data voltages which are then applied to the corresponding pixels in the upper line of the two paired lines; and the same video signal representing the horizontal scanning line as for the upper line is sampled by a clock signal of the timing shifted by ½ cycle from the above clock signal so as to match the number of pixels in the lower line and the shifted arrangement of the pixels with respect to the upper line, to obtain data voltages which are then applied to the corresponding pixels in the lower line of the two paired lines, Thereby, one horizontal scanning line represented by the video signal is displayed using the pair of two adjacent upper and lower lines of pixels during one horizontal scanning period of the video signal, the operation being performed on all lines of pixels to complete the display of an image for one field.

According to the invention, the video signal representing one horizontal scanning line in each field uses two adjacent upper and lower lines of pixels for displaying the horizontal scanning line. Furthermore, for the pixels in the upper line, the video signal correctly corresponding to each pixel is sampled by a clock signal of the timing that matches the arrangement of the pixels, while for the pixels in the lower line, the video signal correctly corresponding to each pixel is sampled by a clock signal whose timing is shifted by the amount of shift of the pixel arrangement with respect to the upper line. Therefore, the image reproducibility is enhanced, resulting in a great improvement in the reproducibility of an image having diagonal lines as compared with the prior art method.

As described above, according to the method of driving a display device subsumed in the invention, a plurality of pixels are arranged in a matrix form having the number of lines twice that of horizontal scanning lines for one field of interlaced scanning video signals, the arrangement of the pixels being shifted horizontally by one half of a pixel between adjacent upper and lower lines. Also, the video signal representing one horizontal scanning line in each field uses the two adjacent upper and lower lines of pixels for displaying the horizontal scanning line. Furthermore, for the pixels in the upper line, the video signal correctly corresponding to each pixel is sampled by a clock signal of the timing that matches the arrangement of the pixels, while for the pixels in the lower line, the video signal correctly corresponding to each pixel is sampled by a clock signal whose timing is shifted by the amount of shift of the pixel arrangement with respect to the upper line. Therefore, the display quality of a reproduced image is enhanced, resulting in a great improvement in the reproducibility of an image having diagonal lines as compared with the prior art method.

Also, the invention provides a driving device for a display device, comprising:

a display device having a plurality of pixels arranged in a matrix form having the number of lines twice that of horizontal scanning lines for one field of interlaced scanning video signals obtained by scanning an original image every other line, the arrangement of the pixels being shifted horizontally by one-half of a pixel between adjacent upper and lower lines;

a line driving circuit that sequentially specifies the lines of pixels to be driven in accordance with the sequence of the lines; and a row driving circuit that applies, to the corresponding pixels in the upper line of the two paired lines, data voltages obtained by sampling a video signal representing one horizontal scanning line by a clock signal of the timing that corresponds to the number of pixels in the upper line and the arrangement of the pixels, while applying, to the pixels in the lower line, data voltages obtained by sampling the video signal representing the horizontal scanning line by a clock signal of the timing shifted by ½ cycle from the above clock signal.

The driving device for a display device further comprises:

a double speed converting circuit that holds a video signal representing one horizontal scanning line out of the supplied interlaced scanning video signals, outputs the thus held video signal by compressing it to ½ time-wise, outputs the supplied horizontal synchronizing signal by converting it into a double speed horizontal synchronizing signal which is a train of pulses recurring at half the frequency of one horizontal scanning period, and outputs the supplied vertical synchronizing signal directly without conversion; and a control circuit that controls the line driving circuit and the row driving circuit in accordance with the double speed horizontal synchronizing signal and vertical synchronizing signal supplied from the double speed converting circuit and supplies the clock signal to the row driving circuit.

Also, according to the invention, the driving device for a display device is provided, wherein the column driving circuit includes:

a shift register for storing the compressed video signal representing one horizontal scanning line supplied from the double speed converting circuit;

a sampling circuit for sampling the video signal held in the shift register in response to the clock signal supplied from the control circuit; and an output buffer for applying data voltages representing the video signal sampled by the sampling circuit to the corresponding pixels.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
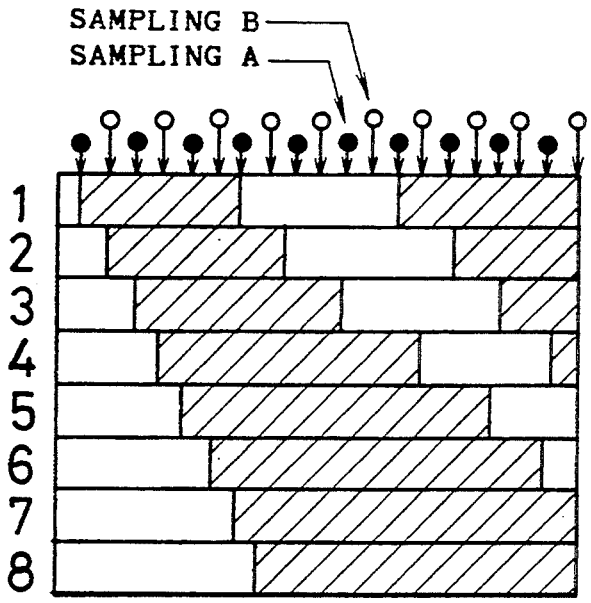
Fig. 1 Prior Art
FIG. 1 is a diagram illustrating interlaced scanning video signals conceptually arranged in the form of an original image.
Figure 2:
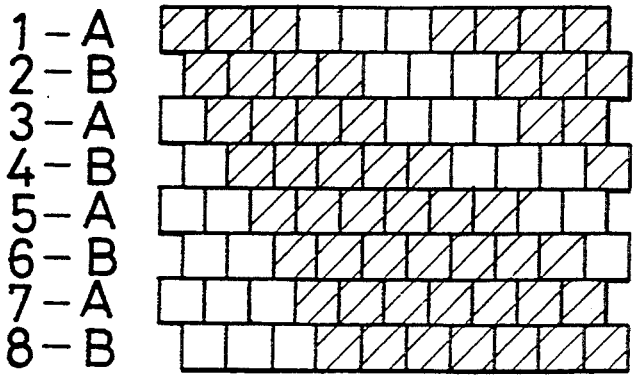
Fig. 2 Prior Art
FIG. 2 is a diagram illustrating an image reproduced from the interlaced scanning video signals and displayed on an interlaced scanning display device.
Figure 3A:
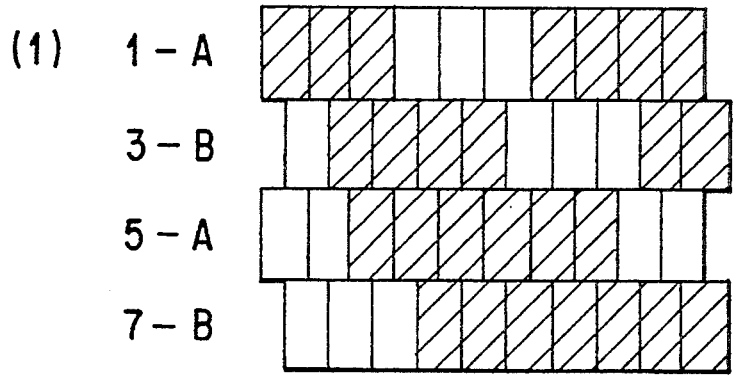
FIG. 3A PRIOR ART
FIG. 3 is a diagram illustrating an image reproduced from the interlaced scanning video signals and displayed on a non-interlaced scanning display device using a prior art driving method.
Figure 3B:
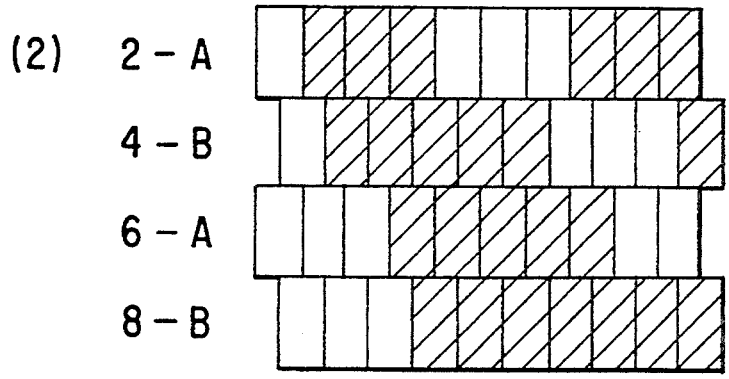
FIG. 3B PRIOR ART
Figure 3C:
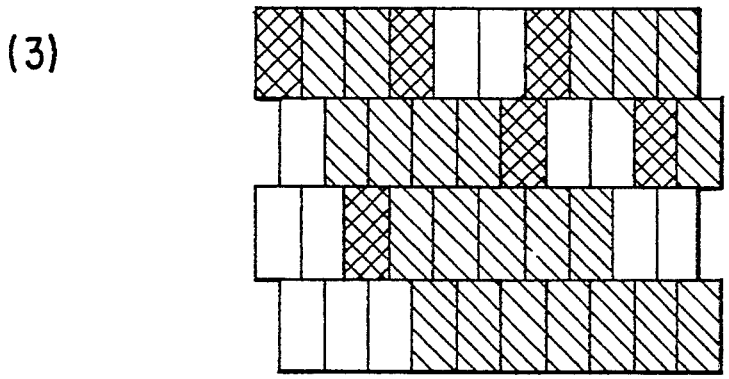
FIG. 3C PRIOR ART

Now referring to the drawing, preferred embodiments of the invention are described below.

Figure 4:
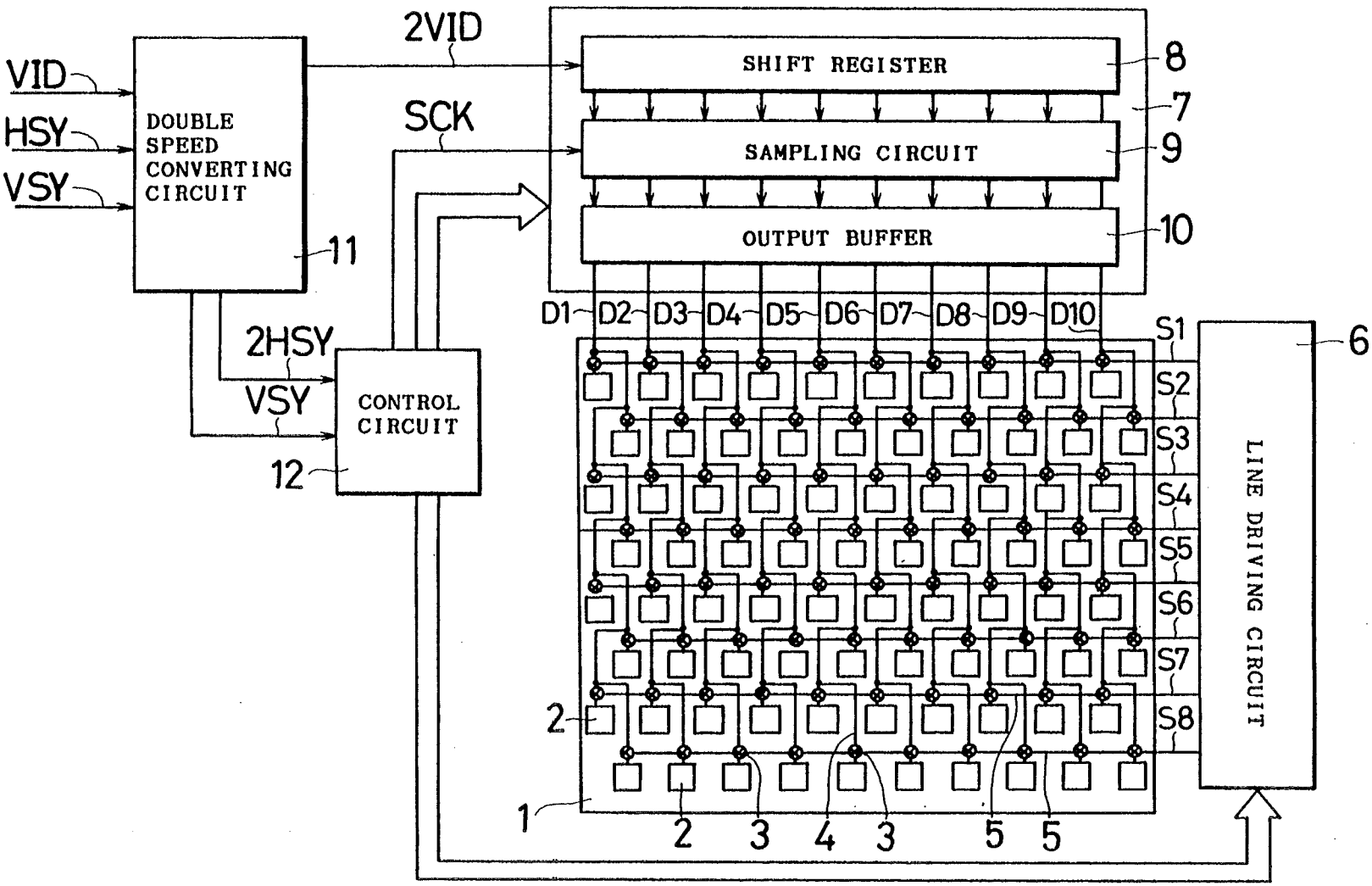
FIG. 4 is a block diagram illustrating the schematic construction of a liquid crystal display device to which a driving method for a display device according to one embodiment of the invention is applied.

FIG. 4 is a block diagram illustrating the schematic construction of an active matrix driving liquid crystal display device to which a driving method in one embodiment of the invention is applied.

The liquid crystal display device shown is a display device which, without using an interlaced scanning method, displays an image using the interlaced scanning video signals previously illustrated in FIG. 1. The liquid crystal display device has a liquid crystal display panel 1 in which a plurality of pixels 2 are disposed in eight lines corresponding to eight horizontal scanning lines of the video signals obtained by horizontally scanning the original image eight times. Each line consisting of ten pixels, the pixels 2 are arranged in a matrix form, totaling $10\times8$ in number. Also, the pixels 2 are arranged in such a way that the pixels 2 in the even-numbered lines are horizontally shifted to the right by one-half of a pixel with respect to the pixels 2 in the odd-numbered lines. Further, there are disposed in the liquid crystal display panel 1 thin film transistors 3 (hereinafter referred to as the TFTs) one each for one pixel 2. Via the TFTs 3, ten source lines 4, the number thereof corresponding to that of pixels per line, are respectively connected as data lines to the pixels in the corresponding rows. On the other hand, there are disposed, corresponding to the respective lines of pixels 2, eight gate lines 5 for sending scanning signals S1 to S8 to activate the TFTs 3 in the respective lines.

Connected to the liquid crystal display panel 1 is a line driving circuit 6 for sequentially specifying the respective lines of pixels 2 in accordance with the sequence of the lines. That is, the scanning signals S1 to S8 for activating the TFTs 3 are selectively supplied from the line driving circuit 6 to the gate lines 5 corresponding to the respective lines of pixels 2.

Also connected to the liquid crystal display panel 1 is a row driving circuit 7 for applying to the respective source lines 4 data voltages D1 to D10 representing respective video signals. The row driving circuit 7 comprises a shift register 8 for storing a video signal representing one horizontal scanning line, a sampling circuit 9 for sampling the video signal held in the shift register 8 at the timing corresponding to the pixels 2 in each line on the liquid crystal display panel 1, and an output buffer 10 for outputting the data voltages D1 to D10 representing the sampled video signals to the respective source lines 4.

A double speed converting circuit 11 contains a line memory that holds the incoming interlaced scanning video signal VID representing one horizontal scanning line, and has a function to compress the thus held video signal VID representing one horizontal scanning line to ½ timewise and to output the same video signal component twice during one horizontal scanning period H of the video signal VID to the shift register 8 in the row driving circuit 7. The double speed converting circuit 11 also has a function to convert a horizontal synchronizing signal HSY, which is input along with the video signal VID, into a double speed horizontal synchronizing signal 2HSY, which is a train of pulses recurring at a cycle ½H, i.e., at half the frequency of one horizontal scanning period H, and to output it to a control circuit 12. A vertical synchronizing signal VSY is also input to the double speed converting circuit 11, but the vertical synchronizing signal VSY is output in its original form without conversion and is supplied to the control circuit 12.

The control circuit 12 is a circuit that controls the line driving circuit 6 and the row driving circuit 7 in accordance with the double speed horizontal synchronizing signal 2HSY and vertical synchronizing signal VSY supplied from the double speed converting circuit 11. A sampling clock signal SCK for clocking the sampling is supplied from the control circuit 12 to the sampling circuit 9 in the column driving circuit 7.

Figure 5:
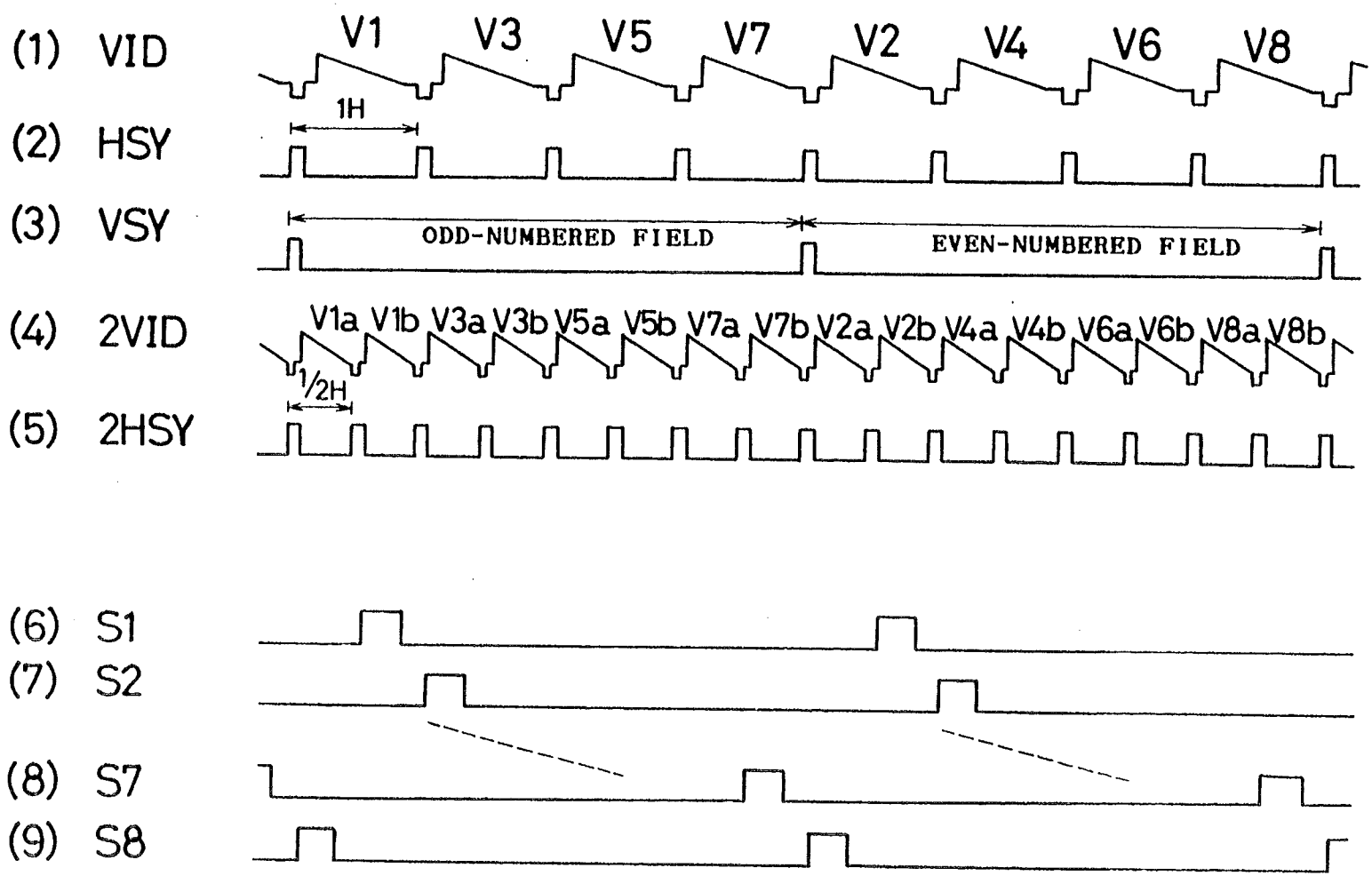
FIG. 5 shows waveforms of various signals in the liquid crystal display device shown in FIG. 4.

FIG. 5 shows waveforms of various signals in the liquid crystal display device. FIG. 5(1) shows the waveform of the interlaced scanning video signal VID that is input to the double speed converting circuit 11, FIG. 5(2) shows the waveform of the horizontal synchronizing signal HSY that is input to the double speed converting circuit 11, FIG. 5(3) shows the waveform of the vertical synchronizing signal VSY, FIG. 5(4) shows the waveform of the double speed video signal 2VID that is output from the double speed converting circuit 11, FIG. 5(5) shows the waveform of the double speed horizontal synchronizing signal 2HSY that is output from the double speed converting circuit 11, and FIG. 5(6) to FIG. 5(9) show the waveforms of the scanning signals S1 to S8 that are supplied to the respective gate lines 5 in the liquid crystal display panel 1 from the row driving circuit 6.

Figure 6:
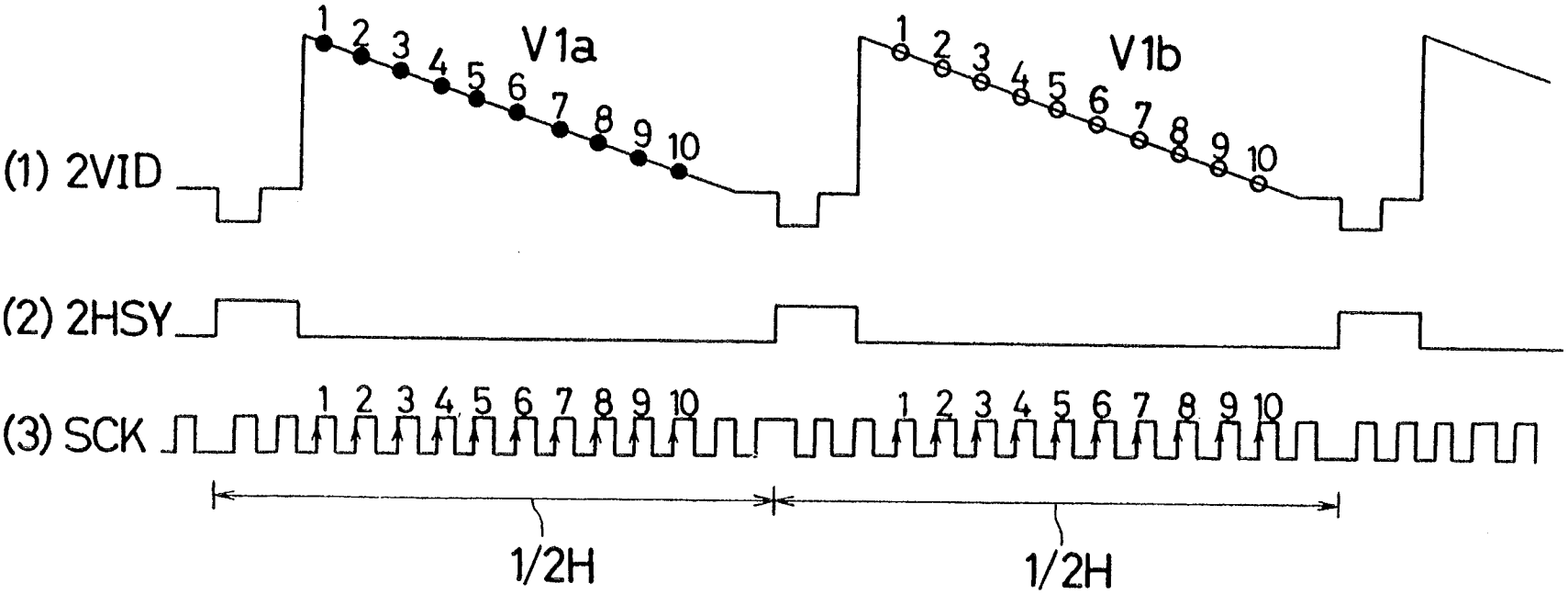
FIG. 6 is a timing chart showing the operation of a sampling circuit in the liquid crystal display device shown in FIG. 4.

FIG. 6 is a timing chart illustrating the sampling operation in the row driving circuit 7. FIG. 6(1) shows the waveform of the double speed video signal 2VID, FIG. 6(2) shows the waveform of the double speed synchronizing signal 2HSY, and FIG. 6(3) shows the waveform of the sampling clock signal SCK.

Figure 7A:
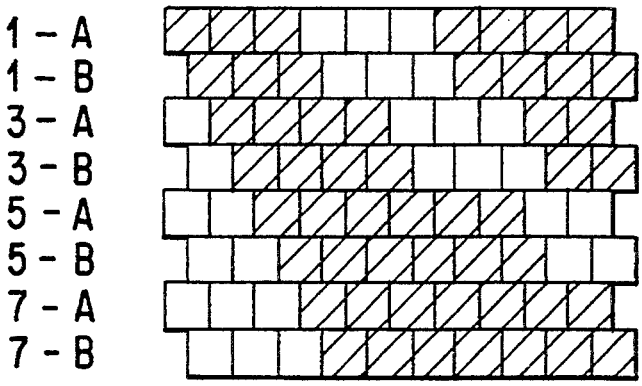
FIG. 7 shows images displayed on the liquid crystal display device shown in FIG. 4.
Figure 7B:
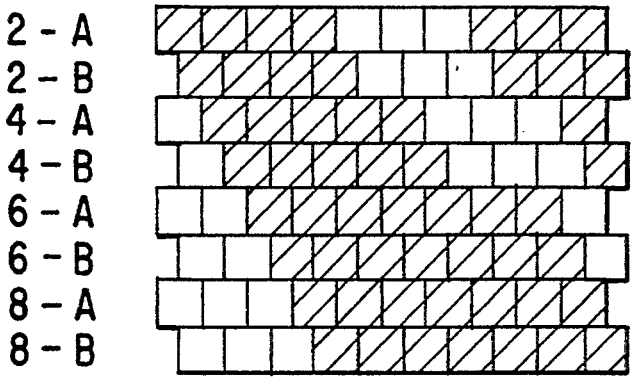
Figure 7C:
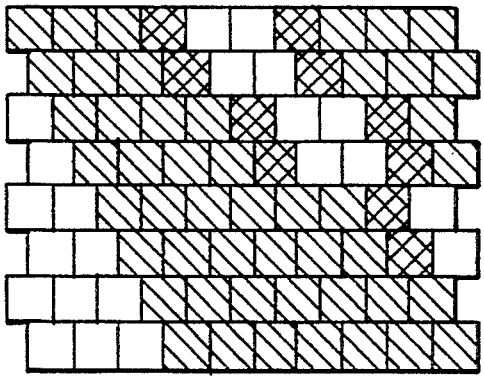

FIG. 7 provides diagrams conceptually illustrating images reproduced from the interlaced scanning video signal VID and displayed on the liquid crystal display panel 1. FIG. 7(1) shows the displayed image of an odd-numbered field, FIG. 7(2) shows the displayed image of an even-numbered field, and FIG. 7(3) shows an image produced by superposing the odd-numbered field image on the even-numbered field.

Referring to FIGS. 5 to 7, we will now describe the operation for displaying an image on the liquid crystal display device from the interlaced scanning video signal VID.

As shown in FIG. 5(1), the video signal VID that is input to the double speed converting circuit 11 is: video signals V1, V3, V5, and V7 representing the odd-numbered horizontal scanning lines of the original image for an odd-numbered field; and video signals V2, V4, V6, and V8 representing the even-numbered horizontal scanning lines of the original image for an even-numbered field.

The video signal VID is held for every horizontal scanning line by the line memory (not shown) in the double speed converting circuit 11, and is compressed to ½ as shown in FIG. 5(4). The compressed double speed video signal 2VID is output twice during one horizontal scanning period H. At the same time, the horizontal synchronizing signal HSY is also output after conversion into the double speed synchronizing signal 2HSY synchronizing with the double speed video signal 2VID, as shown in FIG. 5(5).

The double speed video signal 2VID which is output from the double speed converting circuit 11 is stored in the shift register 8 in the row driving circuit 7. For example, of the identical double speed video signals V1*a* and V1*b* shown in FIG. 5(4) which are input at two different times during one horizontal scanning period H, the former double speed video signal V1*a* is sampled by the sampling circuit 9 during half the horizontal period, i.e. during the period of ½H, and during the next ½H period, the data voltages D1 to D10 representing the sampled signals are respectively applied to the corresponding source lines 4 in the liquid crystal display panel 1 by the output buffer 10. At this time, as shown in FIG. 6(3), ten sampling clock signals SCK corresponding to the number of pixels per line are issued for each of the double speed video signals V1*a* and V1*b*.

During the ½H period in which the output buffer 10 outputs the data voltages D1 to D10 representing the former double speed video signal V1*a*, the sampling of the latter double speed video signal V1*b* is performed, and during the next ½H period, the data voltages D1 to D10 representing the double speed video signal V1*b* are applied to the source lines 4. Thus, the timing at which the data voltages D1 to D10 representing the double speed video signal 2VID that is input to the row driving circuit 7 are applied to the source lines 4 is delayed by ½H from the input timing of the double speed video signal 2VID.

The sampling clock signal SCK that is input from the control circuit 12 to the sampling circuit 9 in the row driving circuit 7 reverses its polarity at every ½H, as shown in FIG. 6(3). Therefore, for example, of the identical double speed video signals V1*a* and V1*b* which are input at two different times to the row driving circuit 7 during one horizontal scanning period H, the former double speed video signal V1*a* is sampled at sampling points indicated by "●" in FIG. 6(1), and the latter double speed video signal V1*b* is sampled at sampling points indicated by "o".

The sampling points "●" correspond to the sampling points A in FIG. 1, while the sampling points "o" correspond to the sampling points B in FIG. 1. That is, the sampling points "●" are chosen to match the arrangement of the pixels 2 in the odd-numbered lines in the liquid crystal display panel 1, while the sampling points "o" are chosen to match the arrangement of the pixels 2 in the even-numbered lines shifted to the right by one half of a pixel with respect to the odd-numbered lines.

In the meantime, the scanning signals S1 to S8 for activating the TFTs 3 are applied from the row driving circuit 6 to the respective gate lines 5 in the liquid crystal display panel 1, as shown in FIG. 5(6) to FIG. 5(9). That is, the scanning signals S1 to S8 are sequentially applied to the gate lines 5 in accordance with the sequence of the lines and in synchronization with the application to the source lines 4 of the data voltages D1 to D10 representing the sampled double speed horizontal synchronizing signal 2HSY.

For example, when the data voltages D1 to D10 representing the double speed video signal V1*a* shown in FIG. 5(4) are applied to the source lines 4, the scanning signal S1 is applied from the row driving circuit 6 to the gate line 5 corresponding to the pixels 2 in the first line. Next, when the data voltages D1 to D10 representing the double speed video signal V1*b* are applied to the source lines 4, the scanning signal S2 is applied to the gate line 5 corresponding to the pixels 2 in the second line. The TFTs 3 on the gate line 5 to which the corresponding scanning signal is applied are turned on, causing the data voltages D1 to D10 applied at that time to the respective source lines 4 to be applied to the respective pixels 2 in tile line corresponding to the gate line 5.

Thus, starting with the first 1H subsequent to the rising of the vertical synchronizing signal VSY indicating the start of a field, the lines of pixels 2 are sequentially selected from the first to the eighth line at the frequency of ½H, and when the data voltages D1 to D10 have been applied to the pixels in all the lines on the liquid crystal display panel 1, the display of one field is completed.

That is, as shown in FIG. 7(1), for an odd-numbered field, the first horizontal scanning line of the original image shown in FIG. 1, represented by the video signal VID sampled at the timing of sampling A, is displayed using the first line of pixels 2 in the liquid crystal display panel 1, the same first horizontal scanning line of the original image shown in FIG. 1, represented by the video signal VID sampled at the timing of sampling B, is displayed using the second line of pixels 2 in the liquid crystal display panel 1, the third horizontal scanning line of the original image shown in FIG. 1, represented by the video signal VID sampled at the timing of sampling A, is displayed using the third line of pixels 2 in the liquid crystal display panel 1, the same third horizontal scanning line of the original image shown in FIG. 1, represented by the video signal VID sampled at the timing of sampling B, is displayed using the fourth line of pixels 2 in the liquid crystal display panel 1, the fifth horizontal scanning line of the original image shown in FIG. 1, represented by the video signal VID sampled at the timing of sampling A, is displayed using the fifth line of pixels 2 in the liquid crystal display panel 1, the same fifth horizontal scanning line of the original image shown in FIG. 1, represented by the video signal VID sampled at the timing of sampling B, is displayed using the sixth line of pixels 2 in the liquid crystal display panel 1, the seventh horizontal scanning line of the original image shown in FIG. 1, represented by the video signal VID sampled at the timing of sampling A, is displayed using the seventh line of pixels 2 in the liquid crystal display panel 1, and the same seventh horizontal scanning line of the original image shown in FIG. 1, represented by the video signal VID sampled at the timing of sampling B, is displayed using the eighth line of pixels 2 in the liquid crystal display panel 1.

Thus, every odd-numbered horizontal scanning line of the original image represented by the video signal VID is displayed using two lines of pixels 2 on the liquid crystal display panel 1, the sampling timing being shifted between the two adjacent upper and lower lines according to the arrangement of pixels 2 shifted by one half of a pixel between the upper and lower lines. This serves to enhance the reproducibility of an original image having diagonal lines such as tile one shown in FIG. 1.

On the other hand, as shown in FIG. 7(2), for an even-numbered field, the second horizontal scanning line of the original image shown in FIG. 1, represented by the video signal VID sampled at the timing of sampling A, is displayed using the first line of pixels 2 in the liquid crystal display panel 1, the same second horizontal scanning line of the original image shown in FIG. 1, represented by the video signal VID sampled at the timing of sampling B, is displayed using the second line of pixels 2 in the liquid crystal display panel 1, the fourth horizontal scanning line of the original image shown in FIG. 1, represented by the video signal VID sampled at the timing of sampling A, is displayed using the third line of pixels 2 in the liquid crystal display panel 1, the same fourth horizontal scanning line of the original image shown in FIG. 1, represented by the video signal VID sampled at the timing of sampling B, is displayed using the fourth line of pixels 2 in the liquid crystal display panel 1, the sixth horizontal scanning line of the original image shown in FIG. 1, represented by the video signal VID sampled at the timing of sampling A, is displayed using the fifth line of pixels 2 in the liquid crystal display panel 1, the same sixth horizontal scanning line of the original image shown in FIG. 1, represented by the video signal VID sampled at the timing of sampling B, is displayed using the sixth line of pixels 2 in the liquid crystal display panel 1, the eighth horizontal scanning line of the original image shown in FIG. 1, represented by the video signal VID sampled at the timing of sampling A, is displayed using the seventh line of pixels 2 in the liquid crystal display panel 1, and the same eighth horizontal scanning line of the original image shown in FIG. 1, represented by the video signal sampled at the timing of sampling B, is displayed using the eighth line of pixels 2 in the liquid crystal display panel 1.

For the even-numbered field also, every even-numbered horizontal scanning line of the original image represented by the video signal VID is displayed using two lines of pixels 2 on the liquid crystal display panel 1, the sampling timing being shifted between the two adjacent upper and lower lines according to the arrangement of pixels 2 shifted by one half of a pixel between the upper and lower lines. As in the case of the odd-numbered field, this serves to enhance the reproducibility of an original image having diagonal lines such as the one shown in FIG. 1.

Thus, on the liquid crystal display panel 1, the odd-numbered field image shown in FIG. 7(1) is superposed on the even-numbered field image shown in FIG. 7(2) to produce an image with good reproducibility as shown in FIG. 7(3).

In the above embodiment, we have described the invention as applied to an active matrix driving liquid crystal display device, but it will also be appreciated that the invention is equally applicable to a simple matrix driving liquid crystal device and an EL display device.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A driving method for a display device, comprising the steps of:

providing a display device having a plurality of pixels which are arranged with a delta arrangement having a number of lines twice that of horizontal scanning lines for one field of interlaced scanning video signals obtained by scanning every other line of an original image, wherein each horizontal scanning line has a pair of adjacent upper and lower lines, the pixels in each lower line being shifted horizontally by one-half of a pixel with respect to the pixels in the upper line;

applying data voltages, which are obtained by sampling a video signal representing one horizontal scanning line by a first clock signal, the timing of which matches the number of pixels in the upper line and the arrangement of pixels in the upper line, to the corresponding pixels in the upper line of each pair of lines; and applying data voltages, which are obtained by sampling the same video signal representing the horizontal scanning line by a second clock signal the timing of which is shifted by ½ cycle from the first clock signal so as to match the number of pixels in the lower line and the shifted arrangement of pixels therein with respect to the upper line, to the corresponding pixels in the lower line of each pair of lines, thereby, one horizontal scanning line is displayed by using the pair of two adjacent upper and lower lines of pixels during one horizontal scanning period of the video signal, the operation being performed on all lines of pixels to complete the display of an image for one field;

wherein said sampling of the same video signal representing the horizontal scanning line by the second clock signal so as to match the number of pixels in the lower line is done while applying the voltage previously obtained by sampling by the first clock signal to match the number of pixels in the upper line, and in a following field data voltages, which are obtained by sampling a video siqnal representing one horizontal scanning line composing a pair of upper and lower lines according to a first clock signal and a second clock signal the timing of the second clock signal is shifted by one-half cycle, are applied to the corresponding pixels in adjacent upper and lower lines of each pair of lines.

2. A driving device for a display device comprising:

the display device for displaying a plurality of pixels arranged in a matrix form having a number of lines which is twice that of the number of horizontal scanning lines for one field of interlaced video signals obtained by scanning every other line of an original image and displaying a plurality of pixels of one frame by a set of said one field and a following field, wherein each horizontal scanning line comprises a pair of upper and lower lines, the pixels connected to each lower line being shifted horizontally by one half of a pixel with respect to the pixels connected to the upper line adjacent to the lower line; and said driving device further comprises a line driving circuit that sequentially specifies the lines of pixels to be driven accordance with the sequence of the lines, and a row driving circuit that, in one field, applied, to the corresponding pixels in the upper line of each pair of lines, data voltages obtained by sampling a video signal which represents picture signal in a horizontal scanning line by a first clock signal corresponding odd-numbered horizontal scanning line of the original image, the timing of which matches the number of pixels in the upper line, while the row driving circuit applies to the pixels in the lower line, data voltages obtained by sampling a video signal representing a horizontal scanning line by a second clock signal, the timing of which is shifted by 1/2 cycle from said first clock signal;

wherein, in the following field, the row driving circuit applies data voltages which are obtained by sampling a video signal representing a horizontal scanning line corresponding even-numbered horizontal scanning line of the original image; and wherein the driving device further comprises:

a double speed converting circuit that holds a video signal representing one horizontal scanning line out of the supplied interlaced scanning video signals and outputs and thus held video signal by compressing its period to ½ of its original period, outputs a double speed horizontal synchronizing signal which is a train of pulses recurring at a frequency which has one-half of one horizontal scanning period, and outputs a vertical synchronizing signal directly without conversion; and a control circuit that controls the line driving circuit and the row driving circuit in accordance with a double speed horizontal synchronizing signal and vertical synchronizing signal supplied from the double speed converting circuit and supplies said clock signal to the row driving circuit.

3. A driving device for a display device as set forth in claim 2, wherein the row driving circuit comprising:

a shift register for storing the compressed video signal representing one horizontal scanning line supplied from the double speed converting circuit;

a sampling circuit for sampling the video signal held in the shift register in response to the clock signal supplied from the control circuit; and an output buffer for applying data voltages representing the video signal sampled by the sampling circuit to the corresponding pixels.

4. A driving device for display device as set forth in claim 2, wherein said sampling of the same video signal representing the horizontal scanning line by the second clock signal so as to match the number of pixels in the lower line is done while applying the voltage previously obtained by sampling by the first clock signal to match the number of pixel in the upper line.

* * * * *